US008657415B2

(12) United States Patent
Kumagai

(10) Patent No.: US 8,657,415 B2
(45) Date of Patent: Feb. 25, 2014

(54) LIQUID EJECTING APPARATUS AND CONTROL METHOD THEREOF

(75) Inventor: Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 213 days.

(21) Appl. No.: 13/271,043

(22) Filed: Oct. 11, 2011

(65) Prior Publication Data

US 2012/0092417 A1 Apr. 19, 2012

(30) Foreign Application Priority Data

Oct. 15, 2010 (JP) ..... 2010-232279

(51) Int. Cl.
*B41J 2/05* (2006.01)

(52) U.S. Cl.
USPC ..... 347/65; 347/68; 347/93

(58) Field of Classification Search
USPC ..... 347/6, 9, 14, 17, 20, 44, 47, 65, 68, 347/70–71, 89, 92–94
See application file for complete search history.

(56) References Cited

U.S. PATENT DOCUMENTS

| | | | | |
|---|---|---|---|---|
| 6,254,214 | B1 * | 7/2001 | Murthy et al. | 347/17 |
| 6,382,753 | B1 * | 5/2002 | Teramae et al. | 347/10 |
| 7,971,981 | B2 * | 7/2011 | Nagashima et al. | 347/89 |

FOREIGN PATENT DOCUMENTS

| | | |
|---|---|---|
| JP | 06-143602 | 5/1994 |
| JP | 2007-015127 | 1/2007 |

* cited by examiner

*Primary Examiner* — Juanita D Jackson
(74) *Attorney, Agent, or Firm* — Workman Nydegger

(57) ABSTRACT

A liquid ejecting apparatus includes: a common liquid chamber which is common to each pressure chamber and stores ink, a first pressure chamber and a second pressure chamber which communicate with the common liquid chamber, a first nozzle which communicates with the first pressure chamber and a second nozzle which communicates with the second pressure chamber, a first piezoelectric vibrator which causes pressure fluctuation in ink in the first pressure chamber and a second piezoelectric vibrator which causes pressure fluctuation in ink in the second pressure chamber, and a communication flow path which makes the first pressure chamber and the second pressure chamber communicate with each other, wherein the flow of ink is generated in the communication flow path by driving the first piezoelectric vibrator and the second piezoelectric vibrator.

8 Claims, 8 Drawing Sheets

LIQUID EJECTING APPARATUS AND CONTROL METHOD THEREOF

BACKGROUND

1. Technical Field

The present invention relates to a liquid ejecting apparatus provided with a liquid ejecting head such as an ink jet type recording head, and a control method thereof.

2. Related Art

As a representative example of a liquid ejecting head, an ink jet type recording head (hereinafter referred to as a recording head) which is mounted on an ink jet type printer (one type of a liquid ejecting apparatus, hereinafter referred to as a printer) which performs recording by discharging and landing ink in the form of liquid onto a recording medium (an ejection target) such as recording paper, for example, can be given. In addition, liquid ejecting heads have been used for ejection of various types of liquids such as a color material which is used for a color filter of a liquid crystal display or the like, an organic material which is used for an organic EL (Electro Luminescence) display, and an electrode material which is used for formation of an electrode.

In recent years, in the above-mentioned printer, a configuration in which a recording head and an ink tank are connected to each other by a pair of tubes for ink circulation and ink is circulated between the ink tank and the recording head by a pump provided midway on the tube for circulation has been proposed (refer to Japanese Patent No. 3097718, for example). According to this configuration, retention of an unwanted material such as thickened ink or air bubbles in the vicinity of a nozzle of the recording head is suppressed.

However, as described above, in the configuration of circulating ink only by the pump outside the recording head, there is a problem in that it is difficult to stabilize the pressure of ink in the recording head. Accordingly, there is concern that a defect in which ink is not normally ejected from the nozzle of the recording head or a flying direction or the like of ink which is ejected is not stable may occur.

SUMMARY

An advantage of some aspects of the invention is that it provides a liquid ejecting apparatus in which it is possible to prevent retention of an unwanted material in the vicinity of a nozzle while stabilizing the pressure of liquid in a liquid ejecting head, and a control method thereof.

According to an aspect of the invention, there is provided a liquid ejecting apparatus including: a common liquid chamber which is common to each pressure chamber and stores liquid; a first pressure chamber and a second pressure chamber which communicate with the common liquid chamber; a first nozzle which communicates with the first pressure chamber and a second nozzle which communicates with the second pressure chamber; a first pressure generation section which causes pressure fluctuation in liquid in the first pressure chamber and a second pressure generation section which causes pressure fluctuation in liquid in the second pressure chamber; and a communication flow path which makes the first pressure chamber and the second pressure chamber communicate with each other, wherein the flow of liquid is generated in the communication flow path by driving the first pressure generation section and the second pressure generation section.

According to the above configuration, since the flow of liquid from the first pressure chamber side to the second pressure chamber side through the communication flow path is generated, it is not necessary to generate an excessively strong flow of liquid in a flow path of the inside of a liquid ejecting head by a pump or the like outside the liquid ejecting head, whereby it becomes possible to prevent retention of unwanted material in the vicinity of the nozzle while stabilizing pressure in the flow path of the inside of the liquid ejecting head.

In the above configuration, it is preferable to adopt a configuration in which the communication flow path is opened to an end portion on a side which is the opposite side to the common liquid chamber in each pressure chamber and communicates with the nozzle.

According to this configuration, it is possible to generate the flow of liquid at a position closer to the nozzle. For this reason, it becomes possible to more reliably prevent retention of the unwanted material in the vicinity of the nozzle.

Further, it is possible to adopt a configuration in which the communication flow path is formed in a state where a virtual extended line from an opening thereof is eccentric with respect to the central axis of the nozzle.

According to this configuration, since the flow of liquid from the communication flow path is made in the direction of the tangent to the nozzle in a plan view, a vortex occurs in the vicinity of the nozzle. It becomes possible to more effectively remove the unwanted material in the vicinity of the nozzle by this vortex.

Further in the above configuration, it is preferable to adopt a configuration in which the flow of liquid is generated in the communication flow path by making the driving timings of the first pressure generation section and the second pressure generation section different from each other.

Further in the above configuration, it is preferable to adopt a configuration in which the direction of the flow of liquid in the communication flow path is changed by changing the driving order of the first pressure generation section and the second pressure generation section.

According to this configuration, by changing the direction of the flow of liquid in the communication flow path, bias of pressure between the first pressure chamber and the second pressure chamber is prevented. Accordingly, it is possible to more reliably stabilize the pressure in the flow path of the inside of the liquid ejecting head.

Further, in the above configuration, it is preferable to adopt a configuration in which the liquid ejecting apparatus further includes a cap member which seals the nozzle and a stronger flow of liquid is generated in the communication flow path by driving each pressure generation section in a state where each nozzle has been sealed by the cap member.

According to this configuration, by generating a stronger flow of liquid in the communication flow path, it becomes possible to more reliably prevent retention of the unwanted material in the vicinity of the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a mode for carrying out the invention will be described with reference to the accompanying drawings. In addition, although in the embodiments which are described below, various limitations are given as the preferred specific examples of the invention, unless the description of intent to limit the invention is particularly given in the following explanation, the scope of the invention is not to be limited to these aspects. Further, in the following, as a liquid ejecting apparatus according to the invention, an ink jet type recording apparatus (hereinafter referred to as a printer) will be taken and described as an example.

Figure 1:
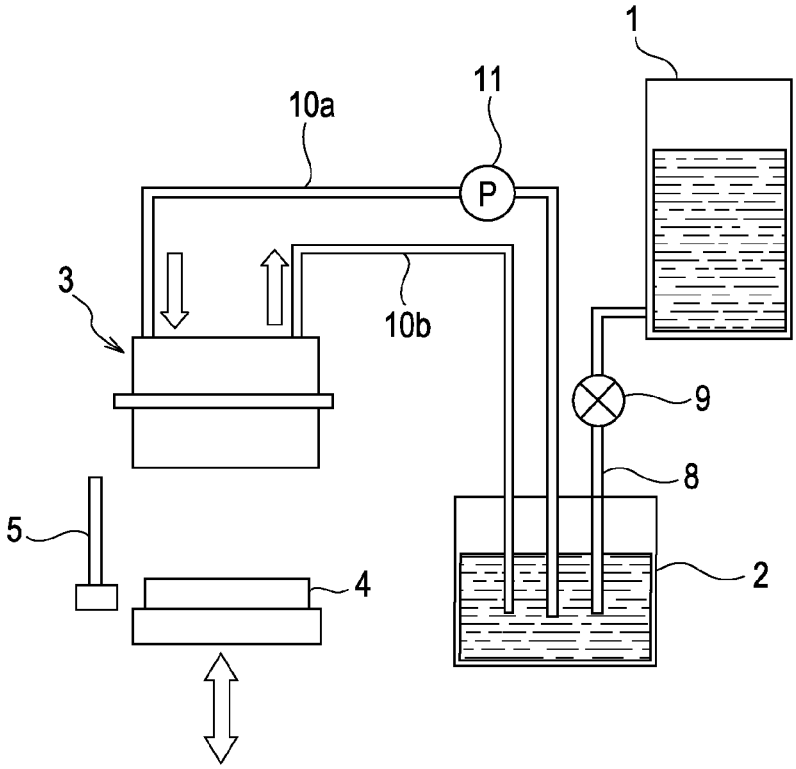
FIG. 1 is a schematic diagram describing the configuration of a printer.

FIG. 1 is a schematic diagram mainly describing an ink circulation pathway in the configuration of the printer. In addition, in this embodiment, the configuration of circulating one type of ink is described. However, since also with respect to other inks, the configuration is the same, a description thereof is omitted.

The illustrated printer is an apparatus which performs recording of an image or the like by ejecting ink in the form of liquid onto the surface of a recording medium (a landing target, not shown) such as recording paper. The printer in this embodiment includes an ink cartridge 1, a sub-tank 2, a recording head 3, a cap member 4, and a wiper member 5. The ink cartridge 1 is a storage member (one type of a liquid storage source) which stores ink (one type of liquid in the invention) and is detachably disposed on the main body side of the printer. The sub-tank 2 is disposed between the ink cartridge 1 and the recording head 3 and configured such that ink from the ink cartridge 1 is supplied thereto through an ink supply tube 8 and the ink is stored therein. A supply adjustment valve 9 is provided midway on the ink supply tube 8, and supply and non-supply of ink from the ink cartridge 1 to the sub-tank 2 can be switched by the supply adjustment valve 9. Switching of the supply adjustment valve 9 is performed depending on the remaining amount of ink which is stored in the sub-tank 2.

The sub-tank 2 and the recording head 3 are connected to each other by a pair of ink circulation tubes 10*a* and 10*b*. The first ink circulation tube 10*a* makes the sub-tank 2 and a first circulation flow path 21*a* (described later) of the recording head 3 communicate with each other. Further, the second ink circulation tube 10*b* makes the sub-tank 2 and a second circulation flow path 21*b* of the recording head 3 communicate with each other. A circulation pump 11, which is composed of, for example, a gear pump or the like, is disposed midway on the first circulation flow path 21*a*. A configuration is made such that by an operation of the circulation pump 11, ink is circulated between the sub-tank 2 and the recording head 3 through the ink circulation tubes 10*a* and 10*b*, as shown in white arrows in FIG. 1. In addition, with respect to a circulation direction of ink, it can be reversed by the circulation pump 11. The details of circulation of ink will be described later.

At a home position which is within a moving range of the recording head 3 and in which the recording head 3 is positioned in a resting state where recording of an image or the like onto the recording medium (landing target) such as recording paper is not performed or the like, the cap member 4 and the wiper member 5 are provided. The cap member 4 is a plate member having a size capable of covering all nozzles 30 of a nozzle formation face (a nozzle plate 27) of the recording head 3 and is made of an elastic member such as a rubber or an elastomer. The cap member 4 is switched between a sealing state where it comes into contact with the nozzle formation face of the recording head 3 which is located at the home position and a standby state where it is separated from the nozzle formation face and stands by, by a movement mechanism (not shown). In the sealing state, since the cap member 4 comes into close contact with the nozzle formation face due to the elasticity thereof, evaporation of a solvent of ink from the nozzles 30 is suppressed. Then, cleaning which will be described later is carried out in the sealing state.

The wiper member 5 is a plate member made of an elastic member such as rubber or an elastomer, similarly to the cap member 4, and is switched between a state where a tip portion thereof comes into contact with the nozzle formation face of the recording head 3 which is located at the home position and a standby state where it is separated from the nozzle formation face and stands by, by a movement mechanism. Then, the recording head 3 moves in the contact state, whereby the tip portion of the wiper member 5 slides on the nozzle formation face. In this way, it is possible to remove excess ink droplets attached to the nozzle formation face, for example, after the cleaning process, so that it is possible to prevent a defect in which ink droplets fall from the recording head 3, thereby staining the recording medium such as recording paper.

Figure 2:
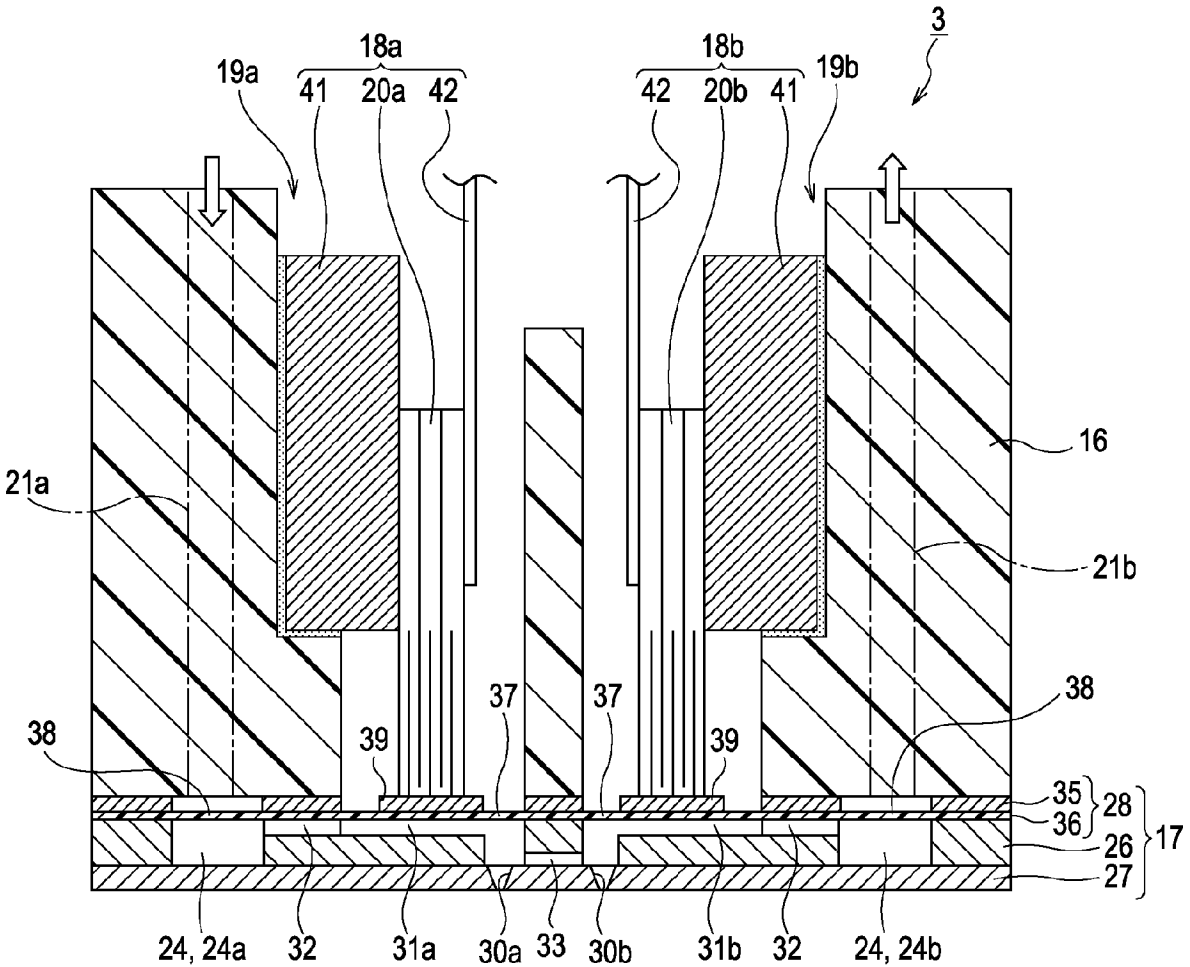
FIG. 2 is a cross-sectional view describing the configuration of a recording head.
Figure 3:
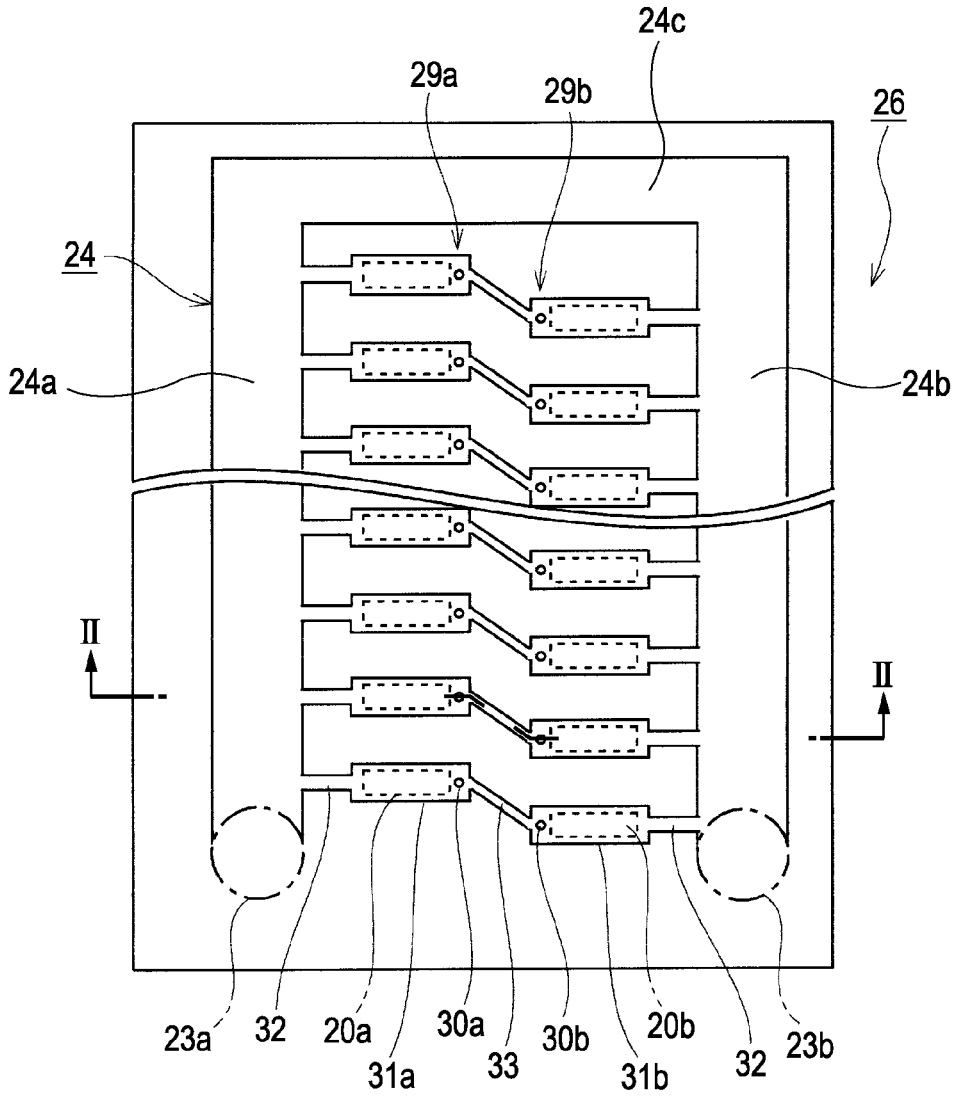
FIG. 3 is a plan view of a flow path substrate.

FIG. 2 is a cross-sectional view describing the configuration of the recording head 3. Further, FIG. 3 is a plan view describing the configuration of a flow path substrate 26 in the recording head 3. As shown in FIG. 2, the recording head 3 is generally constituted by a case 16, a flow path unit 17, and a vibrator unit 18. The case 16 is a block-shaped member made of synthetic resin, and to a tip face (a surface on the side facing the recording medium at the time of recording) thereof, the flow path unit 17 is joined. Further, in the inside of the case 16, a total of two housing cavity portions 19*a* and 19*b* are formed corresponding to two actuator units 18*a* and 18*b*. The actuatar units 18*a* and 18*b* are respectively housed in the housing cavity portions 19*a* and 19*b* in a state where a tip of each piezoelectric vibrator 20 faces an opening on the tip side. The first circulation flow path 21*a* and the second circulation flow path 21*b* are respectively formed outside the respective housing cavity portions 19*a* and 19*b* in the inside of the case 16 in a state where they penetrate in the height direction of the case 16. An end portion (an upper end portion) on the case base end side of the first circulation flow path 21*a* communicates directly with the above-mentioned first ink circulation tube 10*a* or indirectly with the above-mentioned first ink circulation tube 10*a* through an intermediation member or the like, while an end portion (a lower end portion) on the case tip side of the first circulation flow path 21*a* communicates with a common liquid chamber 24 of the flow path unit 17 through a first communication opening 23*a* (refer to FIG. 3). Similarly, an upper end portion of the second circulation flow path 21*b* communicates directly or indirectly with the second ink circulation tube 10*b*, while a lower end portion of the second circulation flow path 21*b* communicates with the common liquid chamber 24 of the flow path unit 17 through a second communication opening 23*b* (refer to FIG. 3).

The flow path unit 17 is constituted by the flow path substrate 26, the nozzle plate 27, and a vibration plate 28. The nozzle plate 27 is a thin plate-like member in which a number of (for example, 360) nozzles 30 are opened and provided in the form of a row at a pitch corresponding to dot formation density and is constituted by, for example, a stainless steel plate. A nozzle row (a nozzle group) is constituted by the nozzles 30 provided in a row. In the nozzle plate 27 of this embodiment, a first nozzle row 29*a* and a second nozzle row 29*b* corresponding to ink of one type (color) are formed side by side in the main scanning direction of the recording head 3. The respective nozzles 30 constituting a nozzle row 29 are arranged in a state where they are shifted by half pitch such that they are shifted in a nozzle row setting direction (a nozzle row direction) with respect to the nozzles 30 of the neighboring nozzle row 29.

The above-mentioned flow path substrate 26 is a plate material made of, for example, a silicon substrate, and a cavity portion which becomes the common liquid chamber 24, a cavity portion which becomes a pressure chamber 31, and a cavity portion which becomes an ink supply port 32 are formed therein by etching or the like. The above-mentioned pressure chamber 31 is a cavity portion which is elongated in a direction approximately perpendicular to the nozzle row direction, and is formed by the number corresponding to the nozzles 30. The pressure chamber 31 communicates at one end portion in a longitudinal direction with the nozzle 30 and at the other end portion with the common liquid chamber 24 through the ink supply port 32. Further, each pressure chamber 31 is formed such that one end portion faces the neighboring nozzle row side and also the pressure chamber 31 is arranged being shifted with respect to the pressure chamber 31 of the neighboring nozzle row in the nozzle row direction.

Further, a pressure chamber 31*a* (equivalent to a first pressure chamber in the invention) corresponding to the first nozzle row 29*a* and a pressure chamber 31*b* (equivalent to a second pressure chamber in the invention) adjacent to the pressure chamber 31*a* and corresponding to the second nozzle row 29*b* communicate one-to-one with each other by a communication flow path 33. In this embodiment, the nozzles from the nozzle 30 on one end side of the nozzle 29 up to the nozzle 30 on the other end side are virtually numbered in order and the pressure chambers corresponding to the nozzles 30 marked with the same number in the adjacent nozzle rows 29 communicate with each other by the communication flow path 33. The communication flow path 33 is a groove-like cavity portion formed by etching from the face on the nozzle plate joining side of the flow path substrate 26, similarly to the pressure chamber 31 or the like, and the cross-sectional area thereof is set to be smaller than the cross-sectional area of the nozzle 30. For this reason, it becomes difficult for foreign matter such as an air bubble to enter into the communication flow path 33. Further, the communication flow path 33 is opened at an inner wall surface on a side which is the opposite side to the common liquid chamber 24 in each of the pressure chambers 31*a* and 31*b* and communicates with the nozzle 30, and preferably opened further at the nozzle side than each of the pressure chambers 31*a* and 31*b*, and more preferably opened at an end portion on a side which communicates with the nozzle 30. Then, a configuration is made such that the flow of ink can be generated in the communication flow path 33 by driving each of a first piezoelectric vibrator 20*a* corresponding to the first pressure chamber 31*a* and a second piezoelectric vibrator 20*b* corresponding to the second pressure chamber 31*b*. In this manner, by making the communication flow path 33 be opened at a position closer to the nozzle 30, it is possible to generate the flow of ink in a position closer to the nozzle 30, as will be described later. For this reason, it becomes possible to more reliably prevent retention of an unwanted material in the vicinity of the nozzle. The details of this point will be described later.

The common liquid chamber 24 is an ink storage cavity portion which is common to each pressure chamber 31 and formed so as to surround the pressure chamber 31*a* group of the first nozzle row 29*a* and the pressure chamber 31*b* group of the second nozzle row 29*b*, as shown in FIG. 3, and is constituted by main liquid chambers 24*a* and 24*b* respectively formed along the first nozzle row 29*a* and the second nozzle row 29*b* and a communication liquid chamber 24*c* which makes the main liquid chambers 24*a* and 24*b* communicate with each other at end portions (upper end portions in FIG. 3) on one side of the main liquid chambers 24*a* and 24*b*. Each pressure chamber 31 communicates with the common liquid chamber 24 through each ink supply port 32. Further, an end portion (a lower left end portion in FIG. 3) on the other side of the main liquid chamber 24*a* communicates with the first circulation flow path 21*a* through the communication opening 23*a* and an end portion (a lower right end portion in FIG. 3) on the other side of the main liquid chamber 24*b* communicates with the second circulation flow path 21*b* through the communication opening 23*b*. In this way, a circulation flow path from the sub-tank 2 through the first ink circulation tube 10*a*, the first circulation flow path 21*a*, the common liquid chamber 24, the second circulation flow path 21*b*, and the second ink circulation tube 10*b* back to the sub-tank 2 is formed. Further, in the flow path unit 17, a series of individual ink flow paths from the common liquid chamber 24 through the ink supply port 32 and the pressure chamber 31 to the nozzle 30 are formed for each nozzle.

In addition, there is also a case where the flow path substrate 26 is constituted by laminating a plurality of substrates. Further, there is also a case where a name, such as a "nozzle communication opening" or the like, for example, that differs from the pressure chamber 31 is granted to a portion (a flow path) from the pressure chamber 31 to the nozzle 30. However, in this embodiment, the pressure chamber 31 is set to include the portion.

The vibration plate 28 is a composite plate material of a double structure in which a resin film 36 such as PPS (polyphenylene sulfide) is laminated on a support plate 35 made of metal such as stainless steel, and is a member which has a diaphragm portion 37 for sealing an opening face on one side of the pressure chamber 31 and varying the volume of the pressure chamber 31 and in which a compliance portion 38 that seals an opening face on one side of the common liquid chamber 24 is formed. Then, the diaphragm portion 37 is constituted by performing etching on the support plate 35 of a portion corresponding to the pressure chamber 31 to remove the portion in an annular pattern, thereby forming an island portion 39 for joining the tip of a free end portion of the piezoelectric vibrator 20. The island portion 39 is formed into the form of a block which is elongated in a direction perpendicular to the nozzle row, similarly to the planar shape of the pressure chamber 31. Further, the resin film 36 around the island portion 39 functions as an elastic body film. Further, the portion functioning as the compliance portion 38, that is, the portion corresponding to the common liquid chamber 24 is composed of only the resin film 36 by etching and removing the support plate 35 to follow the opening shape of the common liquid chamber 24.

The piezoelectric vibrator 20 (one type of a pressure generation section in the invention) in each of the actuator units 18*a* and 18*b* is formed into a comb-tooth shape elongated in a longitudinal direction and is cut into a very thin width of about several tens of μm. Then, the piezoelectric vibrator 20 is configured as a longitudinal vibration type piezoelectric vibrator capable of extending or contracting in the longitudinal direction. Each piezoelectric vibrator 20 is fixed in the state of a so-called cantilever beam in which a fixed end portion is joined to a fixed plate 41 and a free end portion protrudes further to the outside than the tip edge of the fixed plate 41. Then, the tip of the free end portion in each piezoelectric vibrator 20 is joined to the island portion 39 which constitutes the diaphragm portion 37. A flexible cable 42 is electrically connected to the piezoelectric vibrator 20 at the side face of the fixed end portion, which is the opposite side to the fixed plate 41, so as to supply a driving signal for driving each piezoelectric vibrator 20. Further, the fixed plate 41 supporting each piezoelectric vibrator 20 is constituted by a metallic plate material having rigidity capable of taking a reaction force from the piezoelectric vibrator 20. Then, if the free end portion of the piezoelectric vibrator 20 extends or contracts in the longitudinal direction of an element in accordance with a change in the electric potential of an ejection pulse, the island portion 39 is pressed to the pressure chamber 31 side or pulled to the side away from the pressure chamber 31. In this way, the volume of the pressure chamber 31 varies, so that the pressure of ink in the pressure chamber 31 is changed. Ink (an ink droplet) can be ejected from the nozzle 30 with the use of the pressure fluctuation.

Figure 4:
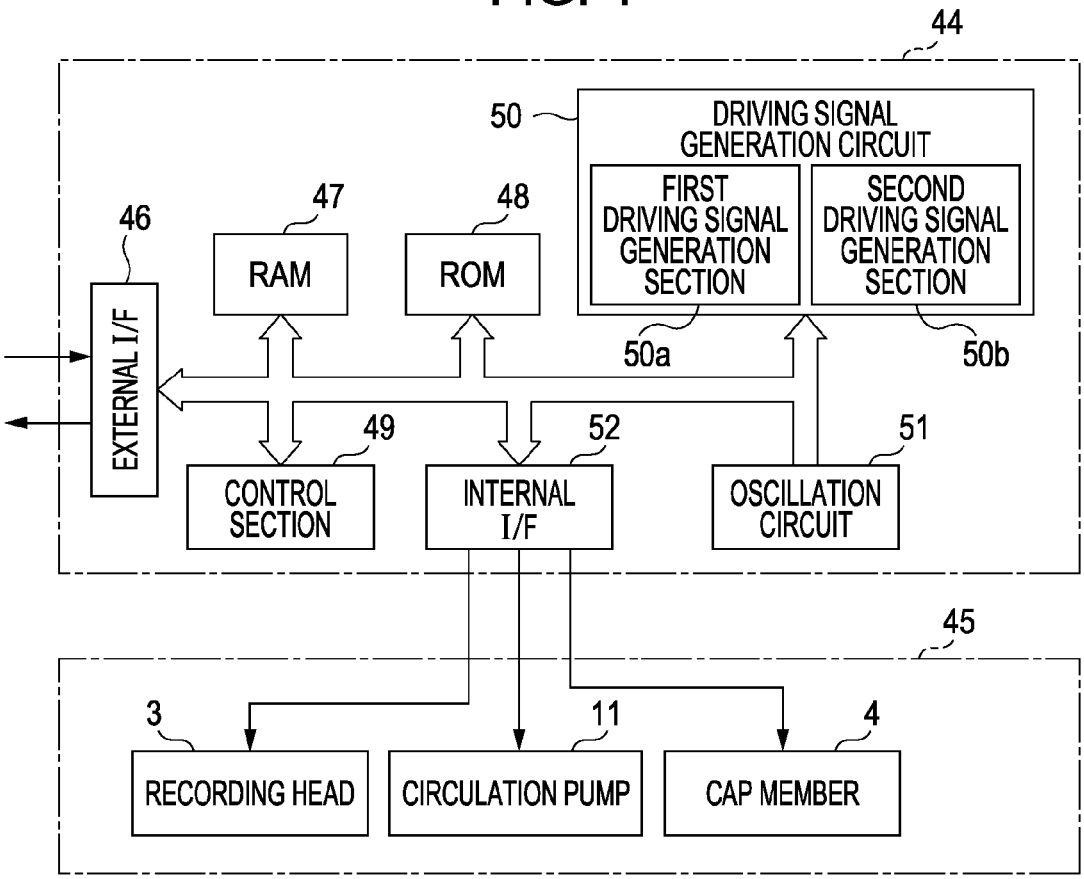
FIG. 4 is a block diagram describing the electrical configuration of the printer.

Next, the electrical configuration of the printer will be described. As shown in FIG. 4, the printer in this embodiment is provided with a printer controller 44 and a print engine 45. The printer controller 44 includes an external interface 46 (an external I/F 46) which receives printing data or the like from an external apparatus such as a host computer (not shown), a RAM 47 in which various data is stored, a ROM 48 in which a control routine or the like for various data processes is stored, a control section 49 composed of a CPU and the like, a driving signal generation circuit 50 capable of generating a driving signal which is supplied to the recording head 3, an oscillation circuit 51 which generates a clock signal, an internal interface 52 (an internal I/F 52) for transmitting the driving signal for a recording operation, a control signal for a maintenance operation, and the like to the print engine 45, and the like. Then, these sections are electrically connected to each other through an internal bus. Further, the print engine 45 includes drive systems such as the recording head 3, the circulation pump 11, and the cap member 4.

The control section 49 is a section which performs various controls in the printer. For example, in the control of the recording operation, the control section 49 generates dot pattern data on the basis of the printing data received from the external apparatus and transmits the generated dot pattern data to the recording head 3. Further, the control section 49 operates the circulation pump 11, thereby making circulation of ink be performed between the sub-tank 2 and the recording head 3, or brings the cap member 4 into contact with the nozzle formation face of the recording head 3 at the time of initial filling or the time of cleaning, thereby sealing the nozzle formation face.

The driving signal generation circuit 50 includes a first driving signal generation section 50*a* capable of generating a first driving signal COM1 and a second driving signal generation section 50*b* capable of generating a second driving signal COM2. Then, the driving signal generation circuit 50 is configured so as to repeatedly generate the first driving signal COM1 and the second driving signal COM2 in a given period T. Each of the driving signals COM1 and COM2 includes an ejection pulse for ejecting ink from the nozzle 30 of the recording head 3, a micro-vibration pulse which finely vibrates a meniscus in the nozzle 30 to an extent in which ink is not ejected, and a counter pulse which will be described later. With respect to the ejection pulse or the micro-vibration pulse, since well-known pulses which are used in this type of printer can be used, explanation thereof is omitted.

Further, the counter pulse is for lowering the driving voltage (a difference in electric potential between the lowest electric potential and the highest electric potential) of the ejection pulse to an extent in which ink is not ejected from the nozzle 30. In this embodiment, in the first driving signal COM1, the ejection pulse and a first micro-vibration pulse are included. Further, the second driving signal COM2 includes the counter pulse which is generated at the same timing as the ejection pulse of the first driving signal COM1, and a second micro-vibration pulse which is generated at a different timing from the first micro-vibration pulse of the first driving signal COM1. The second micro-vibration pulse has the same waveform as that of the first micro-vibration pulse and is generated being delayed by Δt with respect to the first micro-vibration pulse in the same period. Δt is set to be, for example, about ½ of the duration of the whole micro-vibration pulse (the time from a starting end to a terminus of the micro-vibration pulse).

Further, the driving signal generation circuit 50 is configured so as to generate a driving signal for cleaning in a cleaning mode which will be described later. Specifically, a first driving signal for cleaning COM1*c* is generated from the first driving signal generation section 50*a* and a second driving signal for cleaning COM2*c* is generated from the second driving signal generation section 50*b*. In the first driving signal for cleaning COM1*c* in this embodiment, two first cleaning pulses with driving voltage set to be larger than that of the ejection pulse are included within a repetition period T. Further, in the second driving signal for cleaning COM2*c*, two second cleaning pulses which are generated at a different timing from the first cleaning pulses in the first driving signal for cleaning COM1*c* are included within the repetition period T. The second cleaning pulse has the same waveform as that of the first cleaning pulse and is generated being delayed by Δt' with respect to the corresponding first cleaning pulse in the same period.

Next, various operation patterns in a recording mode (a printing mode) of recording an image, a text, or the like onto the recording medium (landing target) such as recording paper in the above-described configuration will be described using the timing charts of FIGS. 6A and 6B. In addition, in FIGS. 6A and 6B, a period in which the piezoelectric vibrator 20 is driven by the ejection pulse is set to be DP, a period in which the piezoelectric vibrator 20 is driven by the counter pulse is set to be CP, a period in which the piezoelectric vibrator 20 is driven by the first micro-vibration pulse is set to be VP1, and a period in which the piezoelectric vibrator 20 is driven by the second micro-vibration pulse is set to be VP2. Further, an upper stage indicated by A is a timing chart about the first pressure chamber 31*a* side and a lower stage indicated by B is a timing chart about the second pressure chamber 31*b* side which communicates with the first pressure chamber 31*a* through the communication flow path 33.

Figure 6A:
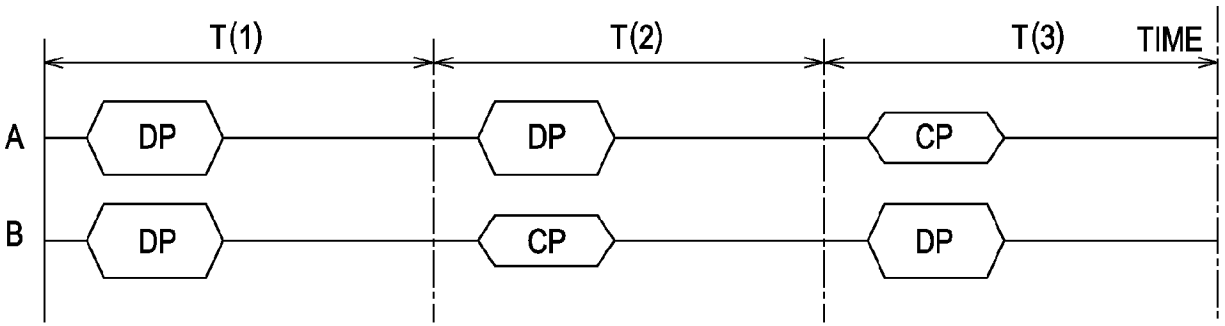
FIGS. 6A and 6B are timing charts of various operation patterns in a recording mode.

In a case where ink is ejected from both a first nozzle 30*a* corresponding to the first pressure chamber 31*a* and a second nozzle 30*b* corresponding to the second pressure chamber 31*b* in the same period, as shown in a period T(1) of FIG. 6A, the ejection pulse of the first driving signal COM1 is applied to each of the first piezoelectric vibrator 20*a* corresponding to the first pressure chamber 31*a* and the second piezoelectric vibrator 20*b* corresponding to the second pressure chamber 31*b* at the same timing. In this way, from the first nozzle 30*a* and the second nozzle 30*b*, ink is ejected at the same time. At this time, since the same degree of change in pressure occurs in each of the pressure chambers 31*a* and 31*b* at the same timing, the flow of ink barely occurs in the communication flow path 33 which makes both the pressure chambers 31*a* and 31*b* communicate with each other.

In a case where in the same period, ink is ejected from the first nozzle 30*a* corresponding to the first pressure chamber 31*a*, while ink is not ejected from the second nozzle 30*b* corresponding to the second pressure chamber 31*b*, as shown in a period T(2) of FIG. 6A, the ejection pulse of the first driving signal COM1 is selected and applied to the first piezoelectric vibrator 20*a* corresponding to the first pressure chamber 31*a*, while at the same timing as this, the counter pulse of the second driving signal COM2 is selected and applied to the second piezoelectric vibrator 20*b* corresponding to the second pressure chamber 31*b*. In this way, ink is ejected from the first nozzle 30*a*. In contrast to this, since in the second pressure chamber 31*b*, a change in pressure of an extent in which ink is not ejected from the second nozzle 30*b* occurs at the same timing as the pressure fluctuation in the first pressure chamber 31*a*, the flow of ink from the first pressure chamber 31*a* side to the second pressure chamber 31*b* side through the communication flow path 33 is suppressed. That is, escaping of the pressure generated at the first pressure chamber 31*a* side to the second pressure chamber 31*b* side is suppressed. Accordingly, in a case where ink is ejected from both the first nozzle 30*a* and the second nozzle 30*b* in the same period and a case where ink is ejected only from the first nozzle 30*a*, variation in ejection characteristics such as the amount of ink which is ejected from the first nozzle 30*a*, a flying speed, and a flying direction is prevented.

Similarly, in a case where ink is ejected only from the second nozzle 30*b* corresponding to the second pressure chamber 31*b* in the same period, as shown in a period T(3) of FIG. 6A, the counter pulse is selected and applied to the first piezoelectric vibrator 20*a*, while at the same timing as this, the ejection pulse is selected and applied to the second piezoelectric vibrator 20*b* corresponding to the second pressure chamber 31*b*. In this way, ink is ejected from the second nozzle 30*b*, whereas in the first pressure chamber 31*a*, a change in pressure of an extent in which ink is not ejected from the first nozzle 30*a* occurs at the same timing as the pressure fluctuation in the second pressure chamber 31*b*. Therefore, the flow of ink from the second pressure chamber 31*b* side to the first pressure chamber 31*a* side through the communication flow path 33 is suppressed.

Figure 5:
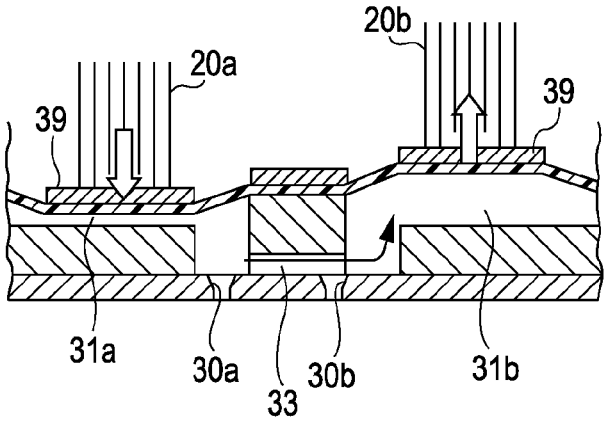
FIG. 5 is a cross-sectional view of the main section of the recording head.
Figure 6B:
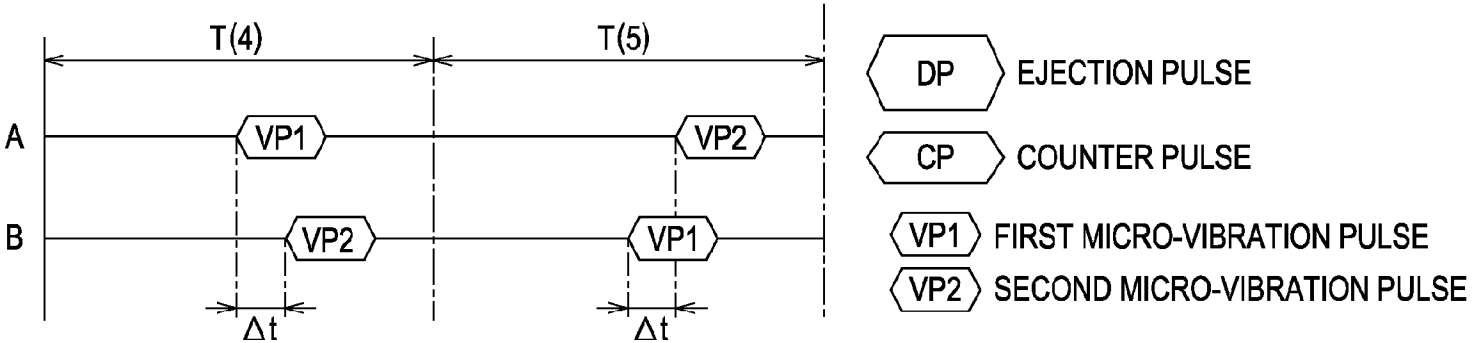

Further, in a case where ink is not ejected in both the first nozzle 30*a* corresponding to the first pressure chamber 31*a* and the second nozzle 30*b* corresponding to the second pressure chamber 31*b* in the same period, as shown in a period T(4) of FIG. 6B, the first micro-vibration pulse of the first driving signal COM1 is selected and applied to the first piezoelectric vibrator 20*a* corresponding to the first pressure chamber 31*a*, while the second micro-vibration pulse of the second driving signal COM2 is selected and applied to the second piezoelectric vibrator 20*b* corresponding to the second pressure chamber 31*b*. In this way, pressure fluctuation of an extent in which ink is not ejected from the nozzle 30 occurs in both the pressure chambers 31*a* and 31*b* and a meniscus in the nozzle 30 is finely vibrated by this pressure fluctuation. Here, as described above, since the second micro-vibration pulse is generated being delayed by Δt with respect to the first micro-vibration pulse in the same period, the driving timing of the first piezoelectric vibrator 20*a* and the driving timing of the second piezoelectric vibrator 20*b* are different from each other. More specifically, as shown in FIG. 5, Δt is set such that at the timing when the first pressure chamber 31*a* contracts up to the reference volume after the first pressure chamber 31*a* is first expanded from the initial reference volume by the driving of the first piezoelectric vibrator 20*a* by the first micro-vibration pulse, the second pressure chamber 31*b* is expanded by the driving of the second piezoelectric vibrator 20*b* by the second micro-vibration pulse.

Accordingly, as shown in FIG. 5, since the internal pressure of the second pressure chamber 31*b* side decreases at the timing when the internal pressure of the first pressure chamber 31*a* side increases, the difference between the internal pressure of the first pressure chamber 31*a* and the internal pressure of the second pressure chamber 31*b* becomes larger. As a result, as shown by an arrow in the drawing, the flow of ink from the first pressure chamber 31*a* side to the second pressure chamber 31*b* side through the communication flow path 33 occurs. For this reason, it is possible to make the flow of ink intensively occur in the vicinity of the nozzle, so that an unwanted material such as thickened ink, settled pigment of ink, or air bubbles in the vicinity of the second nozzle 30*b* in the second pressure chamber 31*b* is easily removed by this flow. That is, retention of the unwanted material in the vicinity of the nozzle 30 becomes difficult. Therefore, it is not necessary to generate the excessively strong flow of ink in the flow path of the inside of the recording head 3 by using the circulation pump 11 or the like outside the recording head 3. Accordingly, it becomes possible to prevent retention of the unwanted material in the vicinity of the nozzle while stabilizing the pressure in the flow path of the inside of the recording head 3. Further, impurities such as ink locally thickened in the vicinity of the nozzle is agitated and uniformized by the flow, whereby it is possible to prevent retention of the impurities. The unwanted material flows to the common liquid chamber 24 side, that is, the above-mentioned circulation pathway side through the ink supply port 32. Therefore, the unwanted material in the circulation pathway is separately discharged to the sub-tank 2 side by circulation of ink by the circulation pump 11. In addition, the flow of ink occurring in the communication flow path 33 when the volume of the second pressure chamber 31*b* contracts alone up to the reference volume after the volume of the second pressure chamber 31*b* is expanded by the second micro-vibration pulse is sufficiently small compared to the above-described case.

As described above, in a case where the flow of ink is generated from the first pressure chamber 31*a* side to the second pressure chamber 31*b* side through the communication flow path 33, imbalance of pressure temporarily occurs between the two. The pressures in both the pressure chambers 31*a* and 31*b* are gradually balanced through the common liquid chamber 24 as time passes. However, in the case (a so-called high-frequency drive) of continuously ejecting ink at shorter intervals, or the like, it is preferable to balance the pressure as soon as possible. Therefore, by generating flow in a direction opposite to the above in the communication flow path 33, it is possible to balance the pressure in a shorter time. Specifically, as shown in a period T(5) of FIG. 6B, the second micro-vibration pulse of the second driving signal COM2 is applied to the first piezoelectric vibrator 20*a* corresponding to the first pressure chamber 31*a*, while the first micro-vibration pulse of the first driving signal COM1 is selected and applied to the second piezoelectric vibrator 20*b* corresponding to the second pressure chamber 31*b*. For this reason, at the timing when the second pressure chamber 31*b* contracts after the volume of the second pressure chamber 31*b* is first expanded by the driving of the second piezoelectric vibrator 20*b* by the first micro-vibration pulse, the first pressure chamber 31*a* is expanded by the driving of the first piezoelectric vibrator 20*a* by the second micro-vibration pulse. In this way, the difference between the internal pressure of the first pressure chamber 31*a* and the internal pressure of the second pressure chamber 31*b* becomes large, such that the flow of ink from the second pressure chamber 31*b* side to the first pressure chamber 31*a* side through the communication flow path 33 occurs. As a result, retention of the unwanted material in the vicinity of the first nozzle 30*a* is prevented and also the pressures in both the pressure chambers 31*a* and 31*b* are balanced in a shorter time. That is, bias of pressure between the first pressure chamber 31*a* and the second pressure chamber 31*b* is prevented. Accordingly, it is possible to more reliably stabilize the pressure in the flow path of the inside of the recording head 3. Further, since ink locally thickened in the vicinity of the nozzle is further agitated by generating flow in the opposite direction, it is possible to further uniformize the thickened ink.

Next, an operation pattern in a cleaning mode (a circulation cleaning mode) of removing the unwanted material in the flow path in the recording head 3 by generating a stronger flow of ink in the flow path in a state where the nozzle formation face of the recording head 3 positioned at the home position has been sealed by the cap member 4 in the above-described configuration will be described using the timing chart of FIG. 7. In addition, in FIG. 7, a period in which the piezoelectric vibrator 20 is driven by a first cleaning pulse is set to be CLP1, and a period in which the piezoelectric vibrator 20 is driven by a second cleaning pulse is set to be CLP2. Further, similarly to FIGS. 6A and 6B, an upper stage indicated by A is a timing chart about the first pressure chamber 31*a* side and a lower stage indicated by B is a timing chart about the second pressure chamber 31*b* side which communicates with the first pressure chamber 31*a* through the communication flow path 33.

Figure 7:
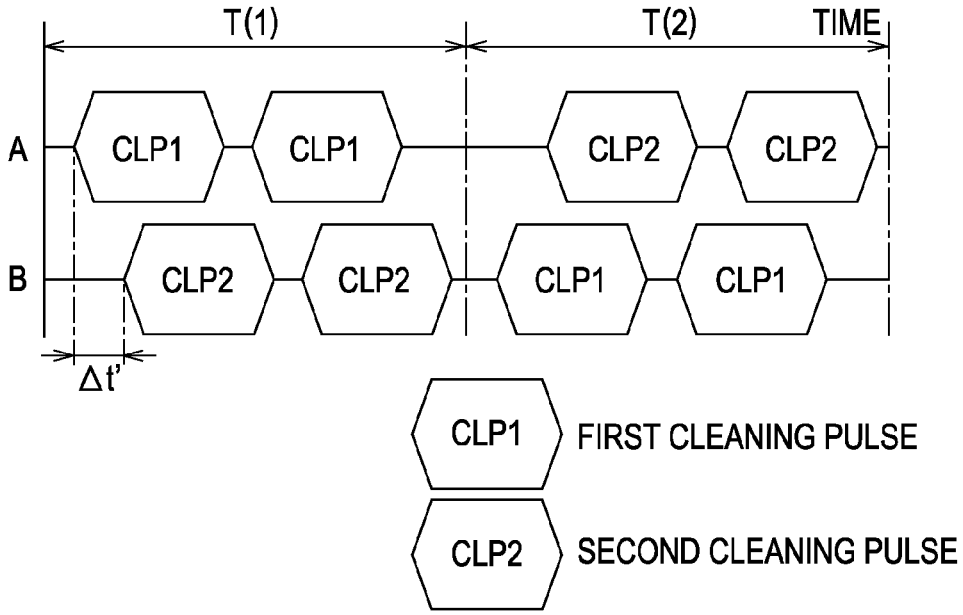
FIG. 7 is a timing chart of an operation pattern in a cleaning mode.

In a cleaning process, as shown in a period T(1) of FIG. 7, two first cleaning pulses of the first driving signal for cleaning COM1*c* are sequentially applied to the first piezoelectric vibrator 20*a* corresponding to the first pressure chamber 31*a*, while two second cleaning pulses of the second driving signal for cleaning COM2*c* are sequentially applied to the second piezoelectric vibrator 20*b* corresponding to the second pressure chamber 31*b*. In this way, in both the pressure chambers 31*a* and 31*b*, stronger pressure fluctuations than that in the case of the driving by the ejection pulse occur. Here, as described above, since each second cleaning pulse of the second driving signal for cleaning COM2*c* is generated being delayed by Δt' with respect to the corresponding first cleaning pulse in the same period, the driving timing of the first piezoelectric vibrator 20*a* and the driving timing of the second piezoelectric vibrator 20*b* are different from each other. More specifically, Δt' is set such that at the timing when the first pressure chamber 31*a* contracts after the volume of the first pressure chamber 31*a* is first expanded by the driving of the first piezoelectric vibrator 20*a* by the first cleaning pulse, the second pressure chamber 31*b* is expanded by the driving of the second piezoelectric vibrator 20*b* by the second cleaning pulse.

In this way, the internal pressure of the second pressure chamber 31*b* side decreases at the timing when the internal pressure of the first pressure chamber 31*a* side increases, and the difference between the internal pressure of the first pressure chamber 31*a* and the internal pressure of the second pressure chamber 31*b* becomes larger than that in the case of the micro-vibration operation in the recording mode. As a result, a stronger flow of ink than that in the case of the micro-vibration operation in the recording mode occurs from the first pressure chamber 31*a* side to the second pressure chamber 31*b* through the communication flow path 33.

Subsequently, as shown in a period T(2) of FIG. 7, two second cleaning pulses of the second driving signal for cleaning COM2*c* are sequentially applied to the first piezoelectric vibrator 20*a* corresponding to the first pressure chamber 31*a*, while two first cleaning pulses of the first driving signal for cleaning COM1*c* are sequentially applied to the second piezoelectric vibrator 20*b* corresponding to the second pressure chamber 31*b*. In this way, at the timing when the second pressure chamber 31*b* contracts after the volume of the second pressure chamber 31*b* is first expanded by the driving of the second piezoelectric vibrator 20*b* by the first cleaning pulse, the first pressure chamber 31*a* is expanded by the driving of the first piezoelectric vibrator 20*a* by the second cleaning pulse. As a result, a stronger flow of ink occurs from the second pressure chamber 31*b* side to the first pressure chamber 31*a* side through the communication flow path 33. Further, the pressures in both the pressure chambers 31*a* and 31*b* are balanced in a shorter time.

In this manner, by repeatedly performing the above-mentioned cleaning operation by the predetermined number of times, the unwanted material such as thickened ink, settled pigment of ink, or air bubbles in the vicinity of the nozzle 30 in each pressure chamber 31 is removed by this flow. The unwanted material flows to the common liquid chamber 24 side, that is, the above-mentioned circulation pathway side through the ink supply port 32. Therefore, the unwanted material in the circulation pathway is discharged to the sub-tank 2 side by circulation of ink by the circulation pump 11.

Next, other embodiments of the invention will be described.

Figure 8A:
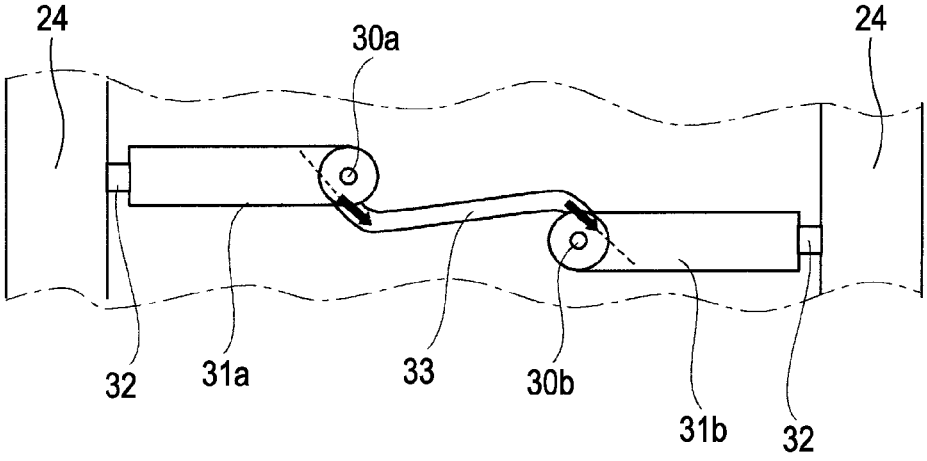
FIGS. 8A and 8B are diagrams describing the configuration of a second embodiment.
Figure 8B:
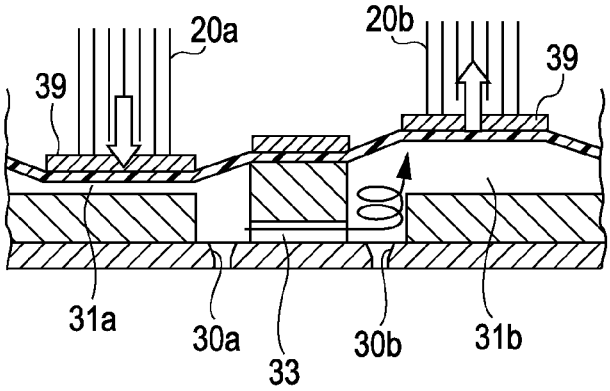

FIGS. 8A and 8B are diagrams describing the configuration of the second embodiment of the invention, wherein FIG. 8A is an enlarged plan view of the flow path substrate 26 and FIG. 8B is a cross-sectional view of the main section of the recording head 3. In this embodiment, the opening position in each of the pressure chambers 31*a* and 31*b* of the communication flow path 33 which makes the first pressure chamber 31*a* and the second pressure chamber 31*b* communicate with each other is made to be different from that in the first embodiment. Specifically, the communication flow path 33 is opened at a position where a virtual extended line (shown by a dashed line in FIG. 8A) from the opening is eccentric with respect to the central axis of the nozzle 30, in one end portion of each of the pressure chambers 31*a* and 31*b*. Then, similarly to the first embodiment, a configuration is made such that the flow of ink can be generated in the communication flow path 33 by driving the piezoelectric vibrator 20*a* corresponding to the first pressure chamber 31*a* and the piezoelectric vibrator 20*b* corresponding to the second pressure chamber 31*b* at the shifted timings. At this time, since the flow of ink from the communication flow path 33 is made in the direction of the tangent to the nozzle 30 in a plan view, as shown in by an arrow in FIG. 8B, a vortex occurs in the vicinity of the nozzle. It becomes possible to more effectively remove the unwanted material in the vicinity of the nozzle by this vortex.

Figure 9:
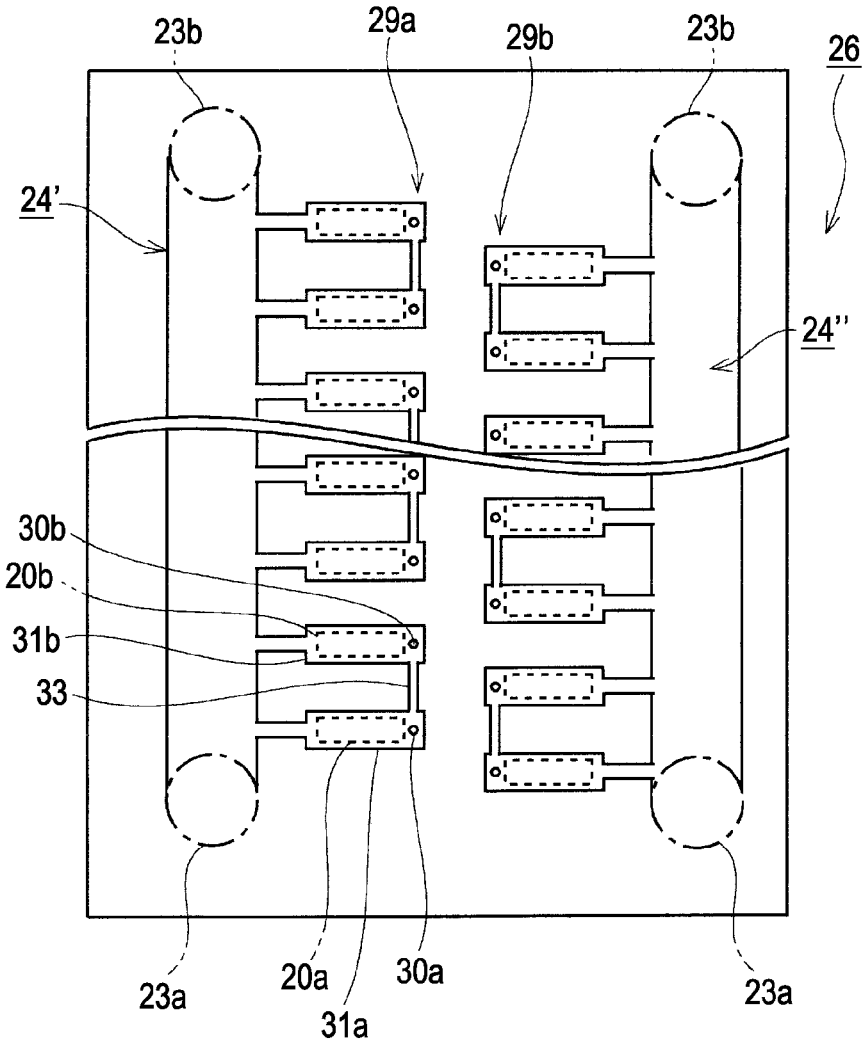
FIG. 9 is a diagram describing the configuration of a third embodiment.

FIG. 9 is a plan view describing the configuration of the flow path substrate 26 in the third embodiment of the invention. In this embodiment, inks of different colors are respectively assigned to the first nozzle row 29*a* and the second nozzle row 29*b*. For this reason, the circulation flow paths which are formed between the nozzle rows and the sub-tank 2 are also separately independent of each other in the first nozzle row 29*a* and the second nozzle row 29*b*. Therefore, the common liquid chamber 24 is also provided for each nozzle row. Specifically, two common liquid chambers 24, a common liquid chamber 24' corresponding to the first nozzle row 29*a* and a common liquid chamber 24" corresponding to the second nozzle row 29*b*, are formed in the flow path substrate 26. Further, as shown in the drawing, a pair of adjacent pressure chambers in the same nozzle row 29 is communicated with each other by the communication flow path 33. That is, the pressure chamber 31 on one side among the adjacent pressure chambers 31 in the same nozzle row 29 is equivalent to the first pressure chambers 31*a* and the pressure chamber 31 on the other side is equivalent to the second pressure chambers 31*b*. The communication flow path 33 is opened at an inner wall of one end portion on a side which is the opposite side to the common liquid chamber 24 in each of the pressure chambers 31*a* and 31*b* and communicates with the nozzle 30. Then, similarly to the first embodiment, a configuration is made such that the flow of ink can be generated in the communication flow path 33 by driving the piezoelectric vibrator 20*a* corresponding to the first pressure chamber 31*a* and the piezoelectric vibrator 20*b* corresponding to the second pressure chamber 31*b*. With respect to a control method in the third embodiment, since it is the same as that in the first embodiment, explanation thereof is omitted. However, also in this configuration, the same effects as those in the first embodiment are obtained.

In addition, in each embodiment described above, a printer of a type in which ink from the printer main body side is received by the sub-tank 2 and the ink is then circulated between the sub-tank 2 and the recording head 3 has been exemplified. However, the invention is not limited thereto and it is also possible to apply the invention to a printer of a type in which ink is not circulated.

In addition, in each embodiment described above, as the pressure generation section, the piezoelectric vibrator 20 of a so-called longitudinal vibration type has been exemplified. However, it is not limited thereto and it is also possible to adopt another pressure generation section such as a piezoelectric vibrator of a so-called flexural vibration type or a heater element, for example.

In addition, in each embodiment described above, the communication flow path 33 is opened at an inner wall surface on a side which is the opposite side to the common liquid chamber 24 in each of the pressure chambers 31*a* and 31*b* and communicates with the nozzle 30, preferably opened further at the nozzle side than each of the pressure chambers 31*a* and 31*b*, and more preferably opened at an end portion on a side which communicates with the nozzle 30.

Further, provided that it is a liquid ejecting apparatus in which ejection control can be performed using a plurality of driving signals, the invention is not limited to a printer and can also be applied to a variety of ink jet type recording apparatuses such as a plotter, a facsimile apparatus, and a copy machine, or liquid ejecting apparatuses other than the recording apparatus, for example, a display manufacturing apparatus, an electrode manufacturing apparatus, a chip manufacturing apparatus, and the like.

The entire disclosure of Japanese Patent Application No. 2010-232279, filed Oct. 15, 2010 is expressly incorporated by reference herein.

What is claimed is:

1. A liquid ejecting apparatus comprising:

a common liquid chamber which is common to each pressure chamber and stores liquid;

a first pressure chamber and a second pressure chamber which communicate with the common liquid chamber;

a first nozzle which communicates with the first pressure chamber and a second nozzle which communicates with the second pressure chamber;

a first pressure generation section which causes pressure fluctuation in liquid in the first pressure chamber and a second pressure generation section which causes pressure fluctuation in liquid in the second pressure chamber; and a communication flow path which makes the first pressure chamber and the second pressure chamber communicate with each other, wherein the flow of liquid is generated in the communication flow path by driving the first pressure generation section and the second pressure generation section, wherein the direction of the flow of liquid in the communication flow path is changed by changing the driving order of the first pressure generation section and the second pressure generation section.

2. The liquid ejecting apparatus according to claim 1, wherein the communication flow path is opened to a side which is the opposite side to the common liquid chamber in each pressure chamber and communicates with the nozzle.

3. The liquid ejecting apparatus according to claim 2, wherein the central axis of the nozzle is not present on a virtual extended line from an opening of the communication flow path.

4. The liquid ejecting apparatus according to claim 1, wherein the flow of liquid is generated in the communication flow path by making the driving timings of the first pressure generation section and the second pressure generation section different from each other.

5. The liquid ejecting apparatus according to claim 1, further comprising:

a cap member which seals the nozzle, wherein a stronger flow of liquid is generated in the communication flow path by driving each pressure generation section in a state where each nozzle has been sealed by the cap member.

6. A method of controlling a liquid ejecting apparatus which includes a common liquid chamber which is common to each pressure chamber and stores liquid, a first pressure chamber and a second pressure chamber which communicate with the common liquid chamber, a first nozzle which communicates with the first pressure chamber and a second nozzle which communicates with the second pressure chamber, a first pressure generation section which causes pressure fluctuation in liquid in the first pressure chamber and a second pressure generation section which causes pressure fluctuation in liquid in the second pressure chamber, and a communication flow path which makes the first pressure chamber and the second pressure chamber communicate with each other, the method comprising:

generating the flow of liquid in the communication flow path by changing the driving order of the first pressure generation section and the second pressure generation section.

7. A liquid ejecting apparatus comprising:

a common liquid chamber which is common to each pressure chamber and stores liquid;

a first pressure chamber and a second pressure chamber which communicate with the common liquid chamber;

a first nozzle which communicates with the first pressure chamber and a second nozzle which communicates with the second pressure chamber;

a first pressure generation section which causes pressure fluctuation in liquid in the first pressure chamber and a second pressure generation section which causes pressure fluctuation in liquid in the second pressure chamber; and a communication flow path which makes the first pressure chamber and the second pressure chamber communicate with each other, wherein the cross-sectional area of the communication flow path is smaller than the cross-sectional area of the first and second nozzle, wherein the flow of liquid is generated in the communication flow path by driving the first pressure generation section and the second pressure generation section.

8. A liquid ejecting apparatus comprising:

a common liquid chamber which is common to each pressure chamber and stores liquid;

a first pressure chamber and a second pressure chamber which communicate with the common liquid chamber;

a first nozzle which communicates with the first pressure chamber and a second nozzle which communicates with the second pressure chamber;

a first pressure generation section which causes pressure fluctuation in liquid in the first pressure chamber and a second pressure generation section which causes pressure fluctuation in liquid in the second pressure chamber; and a communication flow path which makes the first pressure chamber and the second pressure chamber communicate with each other, wherein the flow of liquid is generated in the communication flow path by driving the first pressure generation section and the second pressure generation section, wherein the central axis of the first nozzle is not positioned on a virtual extended line of a direction of which the communication flow path is derived from an opening of the first pressure chamber.

* * * * *